US005114028A

United States Patent [19]

Ring

[11] Patent Number: 5,114,028

[45] Date of Patent: May 19, 1992

[54] CONTAINER WITH INTEGRAL HANDLE STRUCTURE

[75] Inventor: Carl D. Ring, Memphis, Tenn.

[73] Assignee: Ring Can Corporation, Oakland, Tenn.

[21] Appl. No.: 540,947

[22] Filed: Jun. 20, 1990

[51] Int. Cl.[5] ..... B65D 1/42; B65D 23/10; B65D 23/42

[52] U.S. Cl. ..... 215/100 A; 215/1 C; 220/94 A

[58] Field of Search ..... 215/1 C, 100 A; D 9/376, 378, 379; 220/94 A

[56] References Cited

U.S. PATENT DOCUMENTS

| | | | |
|---|---|---|---|
| D. 198,940 | 8/1964 | Mullen | D9/378 |
| D. 200,931 | 4/1965 | Josephsen et al. | D9/378 |
| D. 207,243 | 3/1967 | Kelly | D9/376 |
| D. 209,176 | 11/1967 | Neubauer | D9/376 |
| D. 237,255 | 10/1975 | Plummer | D9/376 |
| D. 279,078 | 6/1978 | Franchi et al. | D9/378 X |
| D. 286,615 | 11/1986 | Lyons | D9/376 X |
| D. 287,226 | 12/1986 | Lyons | D9/376 X |
| 3,400,846 | 9/1968 | Kelly | 215/1 C |
| 4,412,633 | 11/1983 | Guerrazzi et al. | 215/1 C X |
| 4,834,269 | 5/1989 | Cone | 220/94 A X |

*Primary Examiner*—Sue A. Weaver

*Attorney, Agent, or Firm*—Nies, Kurz, Bergert & Tamburro

[57] ABSTRACT

A blow-molded plastic container having a novel neck platform and handle construction which maintains the filling spout in a level position. The construction forms a bridge between the front and rear walls, the bridge having vertical beam support surfaces that resist sag of the spout during post mold cooling and prevent downward deflection of the spout during filling.

3 Claims, 3 Drawing Sheets

CONTAINER WITH INTEGRAL HANDLE STRUCTURE

BACKGROUND OF THE INVENTION

This invention relates generally to blow-molded, thin walled plastic containers and more particularly, to a plastic container of this type having a novel neck and handle construction which eliminates neck-sag during post mold cooling and provides a strong, level neck to facilitate the filling and capping of the container.

In recent years, blow-molded, thin walled plastic containers or bottles, for example 35 pound or 5 gallon jugs, have been commonly used as a standard institutional package for liquid food products such as edible oils. In a jug of this large size, customers desire two primary features, neck levelness and strength. The reason for these features is that the automatic filling and capping machines used to fill the jugs require a dimensionally consistent, level, and strong neck to work efficiently. Jugs conventionally used in the past were neither level nor strong and spillage and other filling and capping problems were encountered.

One attempt to strengthen the neck and spout area of a plastic bottle of this type is illustrated in U.S. Pat. No. 3,400,846. However, this patent proposes a rather complex neck and flange arrangement which requires an intricate mold design and, because of its substantial vertical height, wastes space and needs a more expensive, higher packaging box.

SUMMARY OF THE INVENTION

Accordingly, the primary object of the invention is to provide a plastic container having a novel reinforced neck and handle construction which provides a level filling spout and which supports and maintains the spout in a level position during the filling operation.

Still another object of the invention is to provide the above container wherein the novel neck reinforcement construction has a low profile and thus saves space and minimizes cost of the usual outer packaging box.

A further object of the invention resides in the provision of a blow-molded, thin walled plastic container having a novel neck and handle assembly providing vertical beam support surfaces which span the full width between opposed side walls, and the vertical beam support surfaces maintaining the spout in a level position and preventing downward deflection of the spout during the filling process.

Another object of the invention resides in the provision of the above novel neck and handle assembly whose vertical beam support surfaces cooperate to provide a bridge across the top of the container, the bridge having a high resistance to vertical deflection which maintains the spout in a level position and resists downward deflection of the spout during the filling operation.

These and other objects of the invention will become apparent from reading the following detailed description of the invention wherein reference is made to the accompanying drawings.

DETAILED DESCRIPTION OF THE INVENTION

Figure 1:
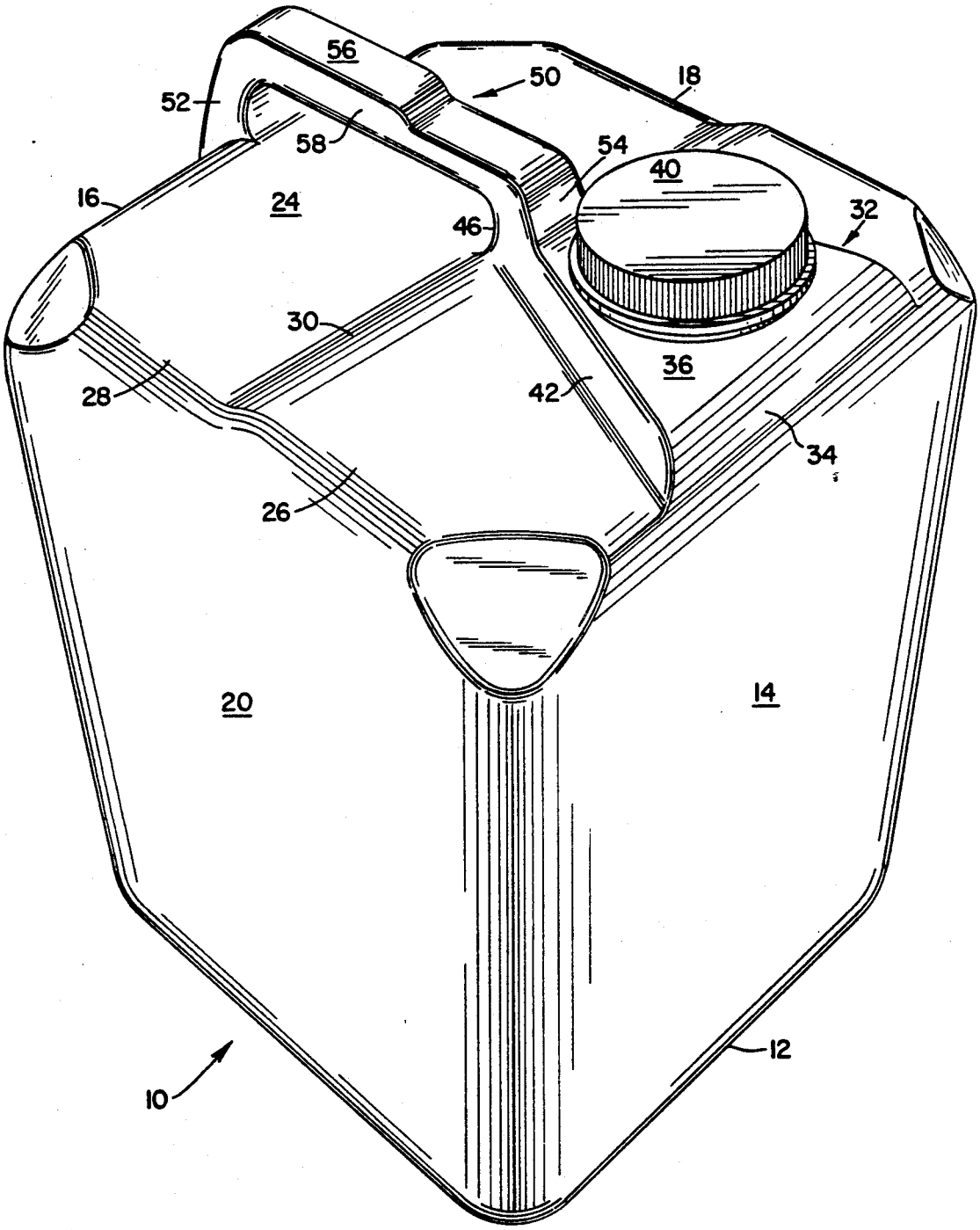
FIG. 1 is a right side perspective view of a blow-molded plastic bottle constructed according to the invention.
Figure 2:
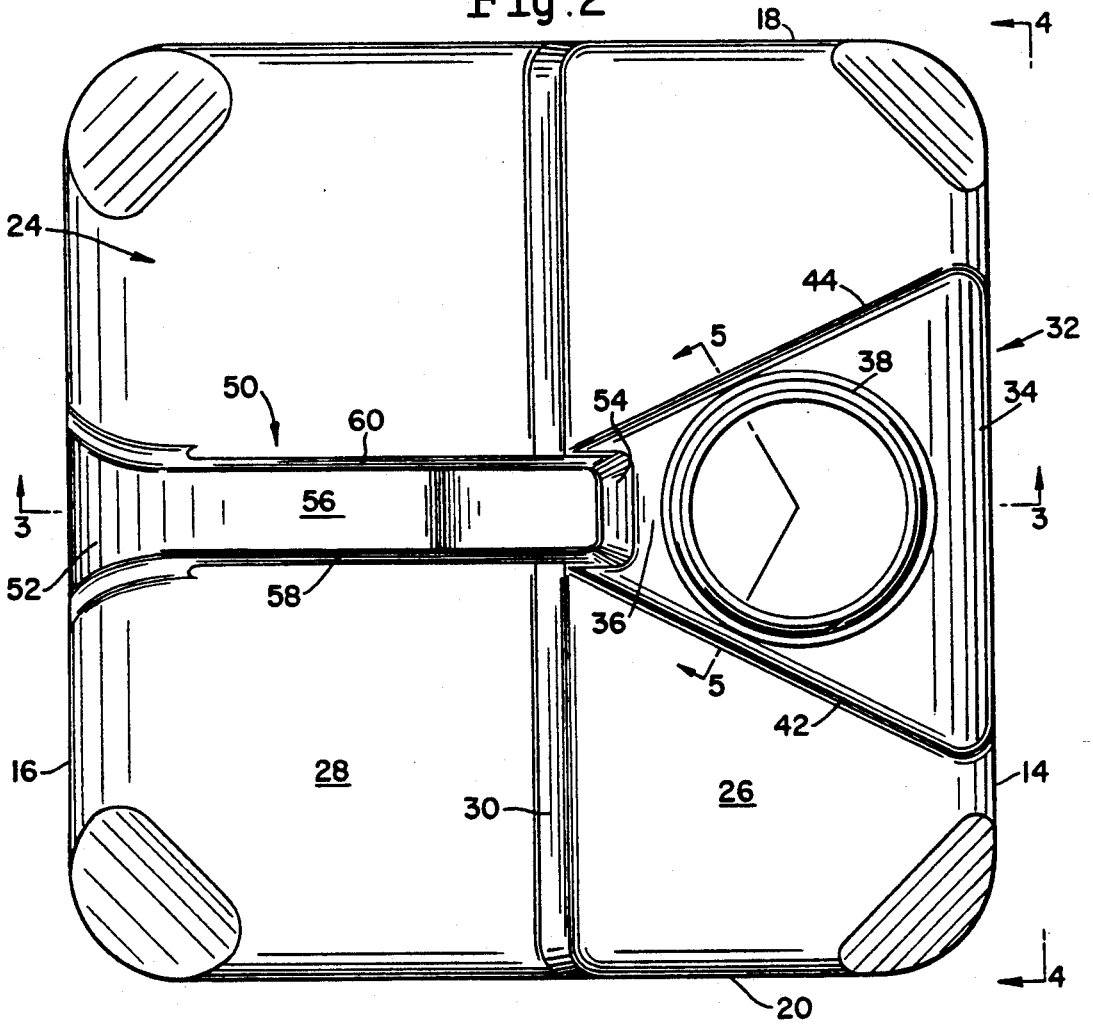
FIG. 2 is a top plan view of the bottle of FIG. 1.
Figure 3:
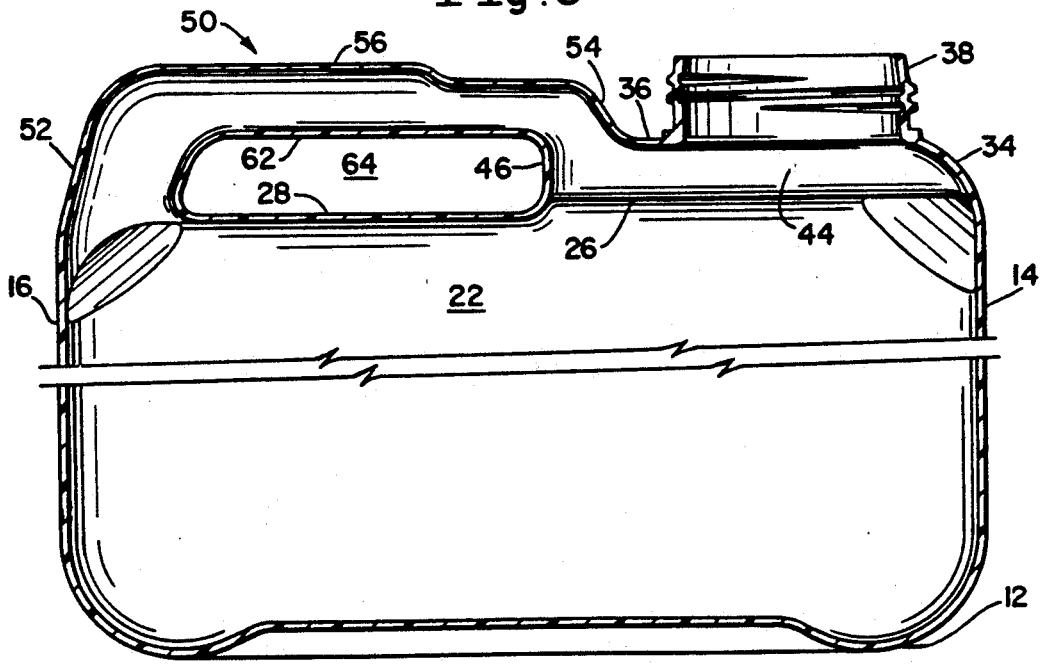
FIG. 3 is a fragmentary sectional view taken along line 3—3 of FIG. 2 with the cap for the spout removed.
Figure 4:
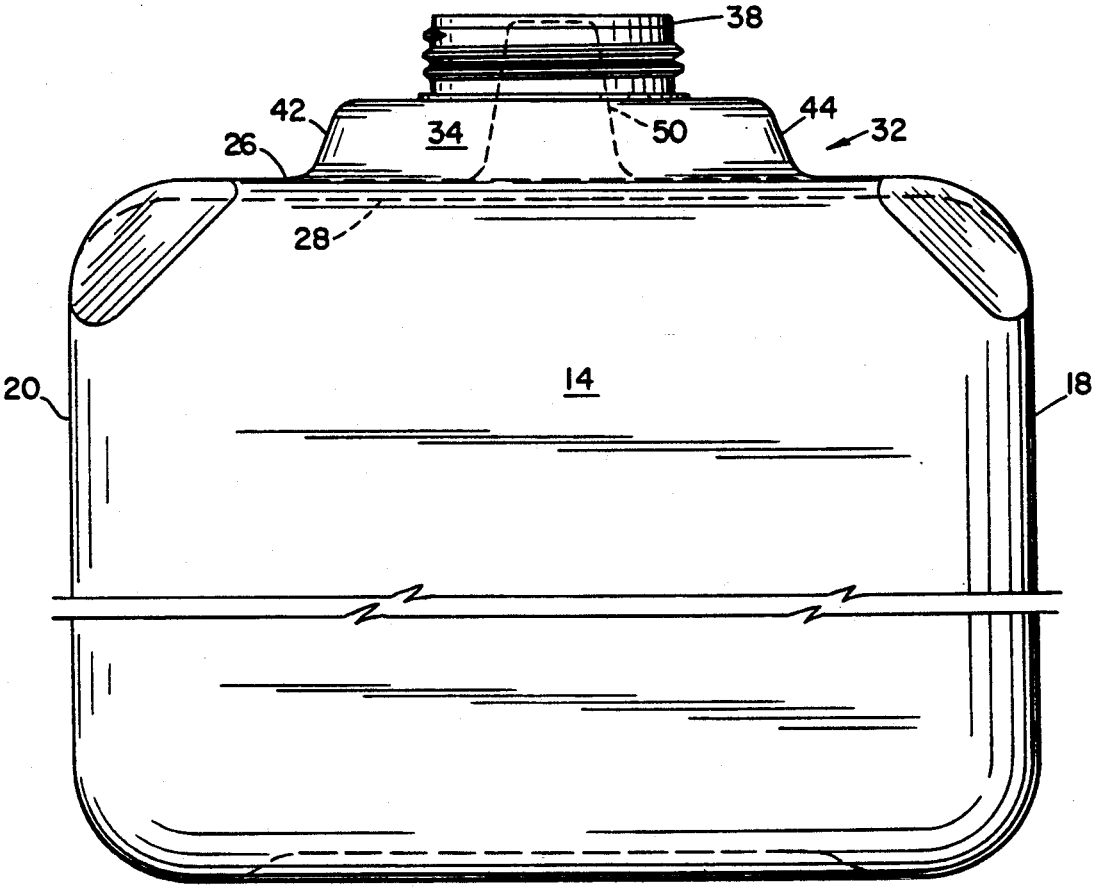
FIG. 4 is a front elevational view taken along line 4—4 of FIG. 2.
Figure 5:
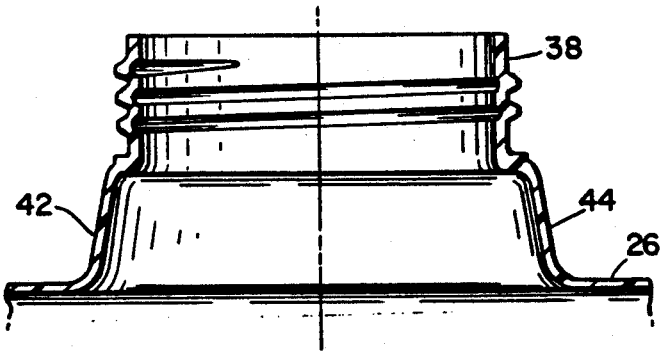
FIG. 5 is a fragmentary sectional view taken along line 5—5 of FIG. 2.

Referring now to the drawings, the one-piece blow-molded plastic container or bottle 10 includes bottom wall 12, vertical front wall 14, rear wall 16, and side walls 18, and 20 which define a liquid containing chamber 22 of generally rectangular cross-section, and a top wall 24 having a raised forward section 26 and a slightly lower rearward section 28 blended together at about the midpoint 30 between walls 14 and 16. As usual, the walls are about 0.020 inch thick.

Integrally formed on top of section 26 is a triangular neck platform 32 having a front or forward wall 34 which extends along and coextensively upwardly from wall 14 and blends with a top wall portion 36 on which is formed a circular, threaded spout 38 normally closed by cap 40. Platform 32 has a pair of vertical side walls 42 and 44 joining section 26 and top wall 36 and converging rearwardly from front wall 34 to a location adjacent the midpoint area 30 where they are joined by a short transverse wall 46.

A narrow U-shaped hollow handle 50 is connected at its rearward end 52 to wall 16 and at its forward end 54 to the rear section of platform 32. Handle 50 is of generally rectangular cross-section and is formed by a generally horizontal, stepped top surface 56 which is slightly below the top of spout 38 and cap 40, vertical side surfaces 58 and 60, and bottom surface 62. Surface 56 blends smoothly with top wall 36 and side surfaces 58 and 60 and bottom surface 62 blend with vertical walls 42, 44, and 46. A finger receiving opening 64, is defined between surface 62 and wall section 28.

The integral construction and design of neck platform 32 and handle 50 act as a bridge or beam extending between opposed walls 14 and 16 and provide a sturdy, rigid support for spout 38. Front wall 34 is a vertical extension of and directly supported by wall 14. Vertical side walls 42 and 44 of platform 32 blend with side walls 58 and 60 of handle 50 and together provide a pair of vertical beam supports that bridge the total span between walls 14 and 18. Acting together, these vertical beam support surfaces prevent sag of platform 36 and spout 38 during the cooling period following the blow molding operation and keep the spout in a desired horizontal level position. During the container filling operation, the same beam support surfaces resist downward deflection of wall 36 and spout 38 and keep the spout level to readily accommodate the automatic filling and capping machines used to fill the bottle.

In the preferred embodiment, platform 32 is of triangular configuration. The front wall 34 is of substantial width and extends directly upwardly from side wall 14 and is supported therefrom. Side walls 42 and 44 converge from front wall 34 along lines which are nearly tangent to the circle of spout 38 and smoothly blend with the side surfaces 58 and 60 of handle 50 and together therewith form a very rigid, strong, stable bridge connection between walls 14 and 16. The vertical beam support surfaces formed by walls 42 and 58 and 44 and 60 increase the moment of inertia of the support bridge to provide a very high resistance to deflection.

As an alternative to the triangular configuration of platform 32, side walls 42 and 44 may diverge from wall 36 to a point at about the diametral line of spout 38 and then extend along straight lines generally parallel to side walls 18 and 20 to front wall 34. This alternate construction may be acceptable, but it is not quite as good as the triangular configuration because of the narrower width of wall 34.

The described bridge design has a low vertical profile which saves space and reduces cost, not only of the bottle itself, but of the cardboard package within which these bottles are usually shipped. Also, because handle 50 constitutes a smooth, continuous, uninterrupted extension of platform 32, the mold by which the bottle is manufactured is of simplified design and therefore, cheaper in cost to manufacture and maintain.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A plastic container comprising a bottom wall, front, rear, and side walls extending from said bottom wall defining a chamber having a generally rectangular cross-section, a top wall covering a substantial portion of said chamber, a neck platform extending upwardly from said top wall and having a circular pouring spout formed thereon, said neck platform having a forward wall of a width at least as great as the diameter of said pouring spout, said forward wall extending along and coextensively upwardly from said front wall, said neck platform further including a pair of vertical side walls extending from said forward wall to a location intermediate said front and rear walls, handle means having a rearward section extending upwardly from said rear wall and a forward section joining said neck platform at said intermediate location, said handle means having vertical side surfaces which blend with and form a continuation of said vertical side walls to provide vertical support surfaces substantially spanning the total distance between said front and rear walls.

2. The container of claim 1, said forward wall as a width greater than the diameter of said spout, said vertical side walls extending rearwardly in converging fashion from said forward wall to said intermediate location to define a substantially triangular neck platform.

3. The container of claim 2, said vertical side walls converging along lines which are nearly tangent to said circular spout.

* * * * *